United States Patent [19]

Wesley

[11] Patent Number: 5,054,138

[45] Date of Patent: Oct. 8, 1991

[54] CRIB APPARATUS

[76] Inventor: Maria Wesley, P.O. Box 490, Port Ewen, N.Y. 12466

[21] Appl. No.: 682,341

[22] Filed: Apr. 9, 1991

[51] Int. Cl.[5] ..... A47D 7/03

[52] U.S. Cl. ..... 5/93.1; 5/308; 5/312; 5/508; 219/201; 219/217

[58] Field of Search ..... 5/93.1, 93.2, 96, 308, 5/58, 312, 18.1, 508; 219/201, 217

[56] References Cited

U.S. PATENT DOCUMENTS

| | | | |
|---|---|---|---|
| 479,071 | 7/1892 | Holstein | 5/58 |
| 1,082,082 | 12/1913 | Jiranek | 5/93.1 |
| 1,298,873 | 4/1919 | Boyd | 5/96 |
| 1,815,616 | 7/1931 | Feldman | 5/308 |
| 2,109,267 | 2/1938 | Grosser | 5/308 |
| 2,267,176 | 12/1941 | Turner | 5/93.1 |

*Primary Examiner*—Alexander Grosz

*Attorney, Agent, or Firm*—Leon Gilden

[57] ABSTRACT

A crib apparatus is arranged wherein the crib includes a crib rear wall, a forward crib wall, a headboard wall, and a foot board wall orthogonally mounted relative to a top floor, wherein the top floor is spaced from a bottom floor defining a mattress cavity therebetween, wherein the mattress cavity includes an entrance opening, with a door coextensively and pivotally mounted relative to the entrance opening. A mattress is slidably mounted within a mattress support plate, with the mattress support plate including a plurality of pivotal legs extending downwardly relative from the mattress plate for support of the mattress for cleaning and maintenance of the mattress during use. Modifications of the invention includes heated support cavities mounted within the cylindrical cavities for support of infant food and fluid nursing bottle members.

5 Claims, 5 Drawing Sheets

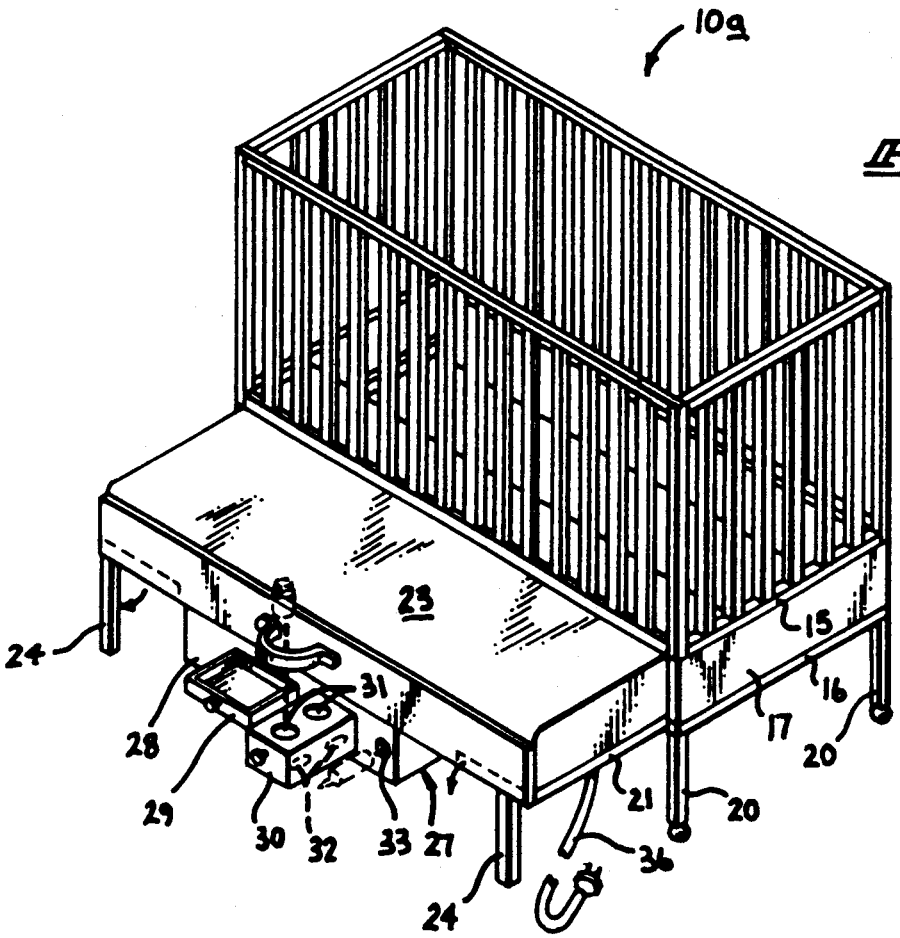
Fig 9
Fig 10
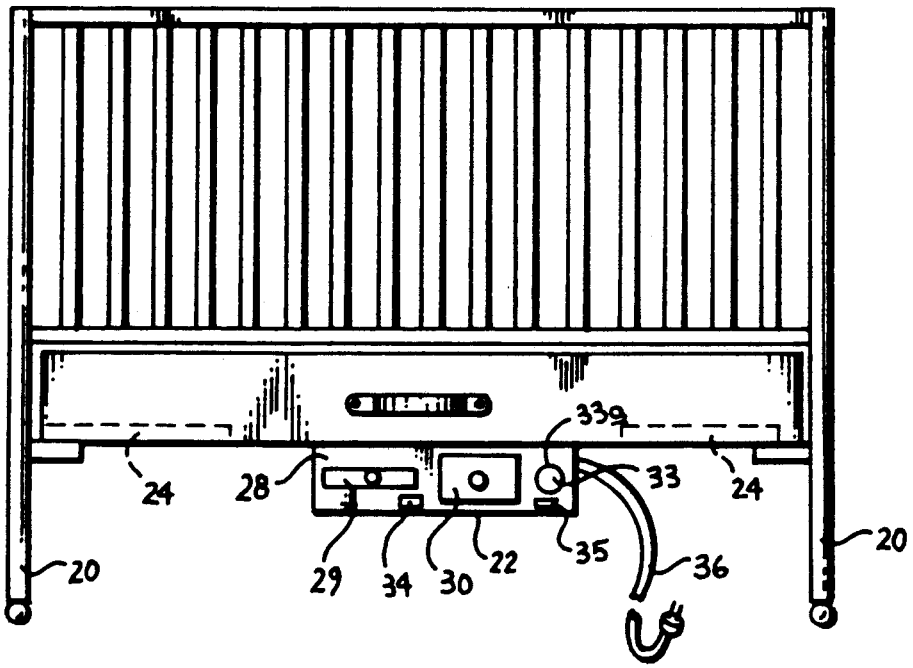

CRIB APPARATUS

BACKGROUND OF THE INVENTION

1. Field of the Invention

The field of invention relates to crib structure, and more particularly pertains to a new and improved crib apparatus wherein the same is arranged for access to a mattress through a sliding plate mounted underlying the floor of the mattress.

2. Description of the Prior Art

Various crib structure of various types have been utilized in the prior art to provide care and ease of use of the crib structure. Such apparatus is exemplified in U.S. Pat. No. 1,563,428 to Melton wherein a child's bed is arranged slidably mounted underlying a conventional bed.

U.S. Pat. No. 2,651,057 to Power sets forth a combination crib and playpen arranged for expansion of the crib structure into a playpen organization.

U.S. Pat. No. 2,507,060 to Surface sets forth a crib structure for utilization with a bed for mounting and underlying the bed structure.

As such, it may be appreciated that there continues to be a need for a new and improved crib apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of crib apparatus now present in the prior art, the present invention provides a crib apparatus wherein the same sets forth a mattress slidably mounted within a crib mattress cavity, wherein the mattress is mounted upon a sliding crib plate permitting sliding removal of the mattress underlying the crib floor for access to the mattress for cleaning and maintenance thereof. As such, the general purpose of the present invention, which will be described subsequently in greater detail, is to provide a new and improved crib apparatus which has all the advantages of the prior art crib apparatus and none of the disadvantages.

To attain this, the present invention provides a crib apparatus wherein the crib includes a crib rear wall, a forward crib wall, a headboard wall, and a foot board wall orthogonally mounted relative to a top floor, wherein the top floor is spaced from a bottom floor defining a mattress cavity therebetween, wherein the mattress cavity includes an entrance opening, with a door coextensively and pivotally mounted relative to the entrance opening. A mattress is slidably mounted within a mattress support plate, with the mattress support plate including a plurality of pivotal legs extending downwardly relative from the mattress plate for support of the mattress for cleaning and maintenance of the mattress during use. Modificiations of the invention include heated support cavities mounted within the cylindrical cavities for support of infant food and fluid nursing bottle members.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved crib apparatus which has all the advantages of the prior art crib apparatus and none of the disadvantages.

It is another object of the present invention to provide a new and improved crib apparatus which may be easily and efficiently manufactured and marketed.

It is a further object of the present invention to provide a new and improved crib apparatus which is of a durable and reliable construction.

An even further object of the present invention is to provide a new and improved crib apparatus which is susceptible of a low cost of manufacture with regard to both materials and labor, and which accordingly is then susceptible of low prices of sale to the consuming public, thereby making such crib apparatus economically available to the buying public.

Still yet another object of the present invention is to provide a new and improved crib apparatus which provides in the apparatuses and methods of the prior art some of the advantages thereof, while simultaneously overcoming some of the disadvantages normally associated therewith.

Still another object of the present invention is to provide a new and improved crib apparatus wherein the same is arranged for sliding removal of the mattress structure from a mattress cavity for access to the crib mattress for cleaning and maintenance thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an isometric illustration of a modification of the instant invention.

FIG. 10 is an orthographic front view of the modification of the instant invention.

DESCRIPTION OF THE PREFERRED EMBODIMENT

Figure 1:
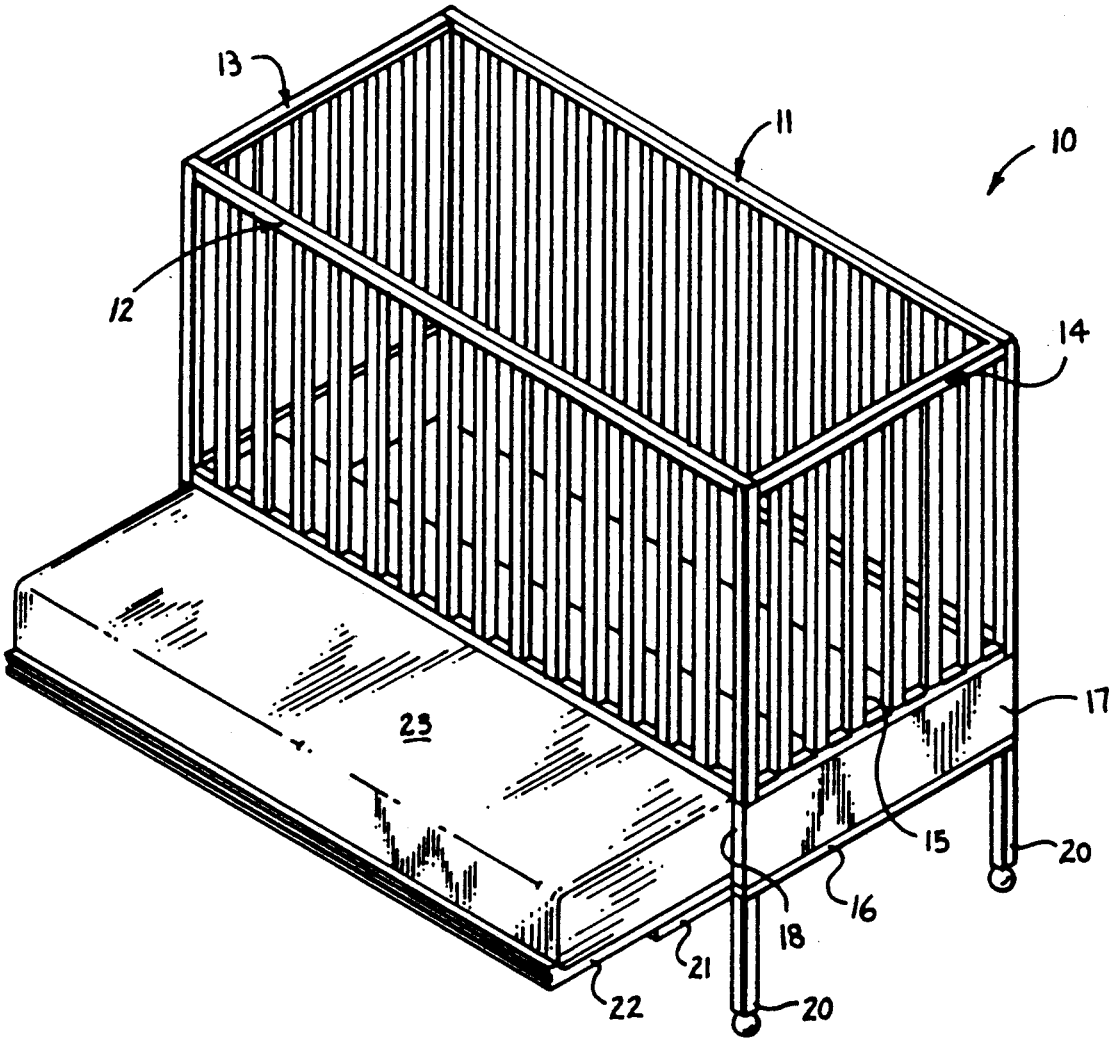
FIG. 1 is an isometric illustration of the instant invention.
Figure 2:
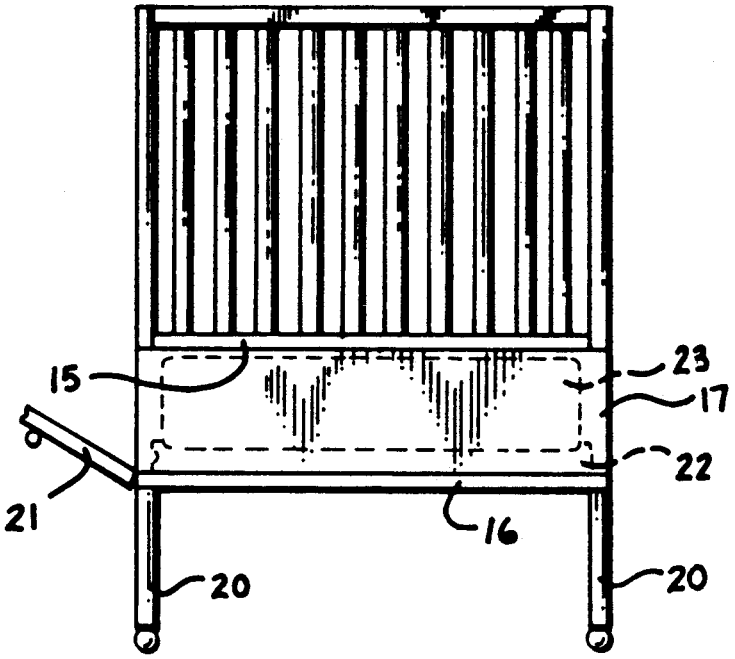
FIG. 2 is an orthographic end view of the instant invention with the mattress cavity door in a partially open configuration.
Figure 3:
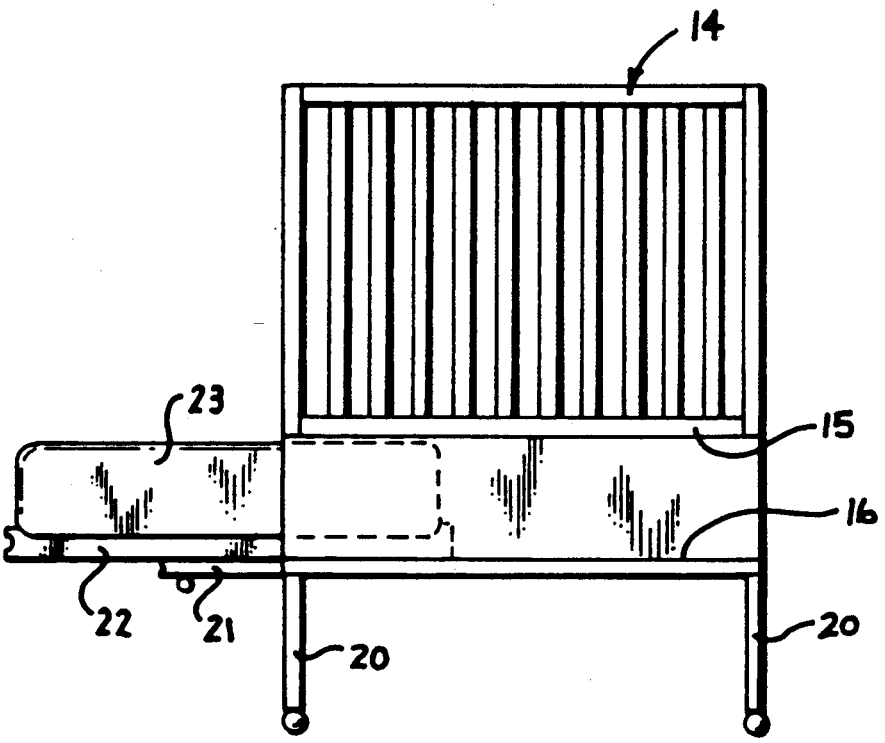
FIG. 3 is an orthographic end view, taken in elevation, of the mattress slidably mounted in a partially removed orientation relative to the crib structure.
Figure 4:
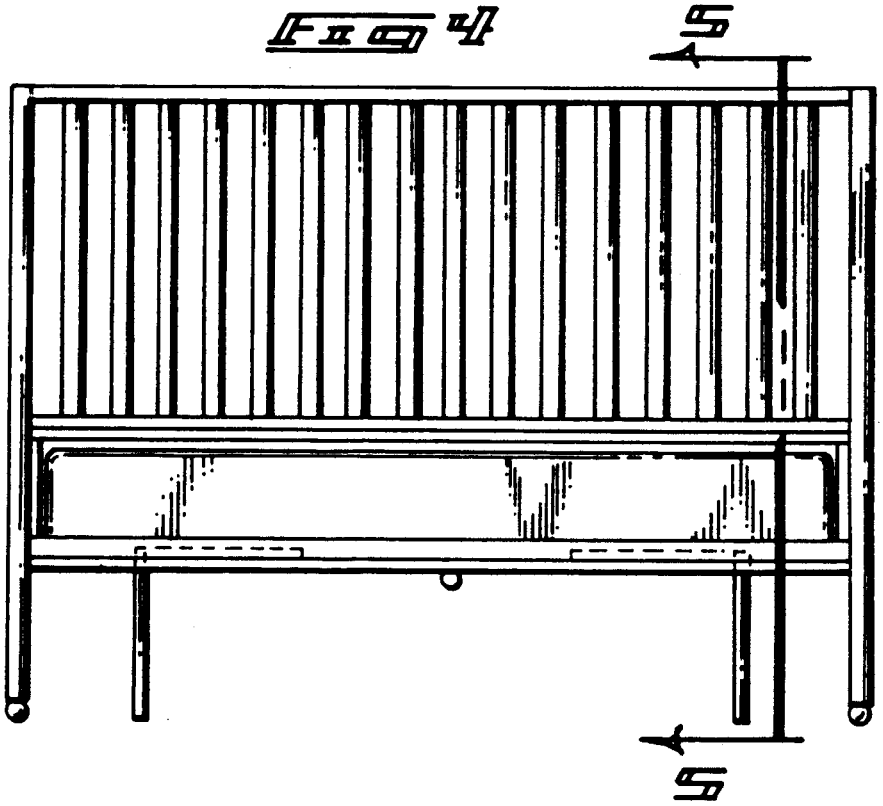
FIG. 4 is an orthographic frontal view of the instant invention.
Figure 5:
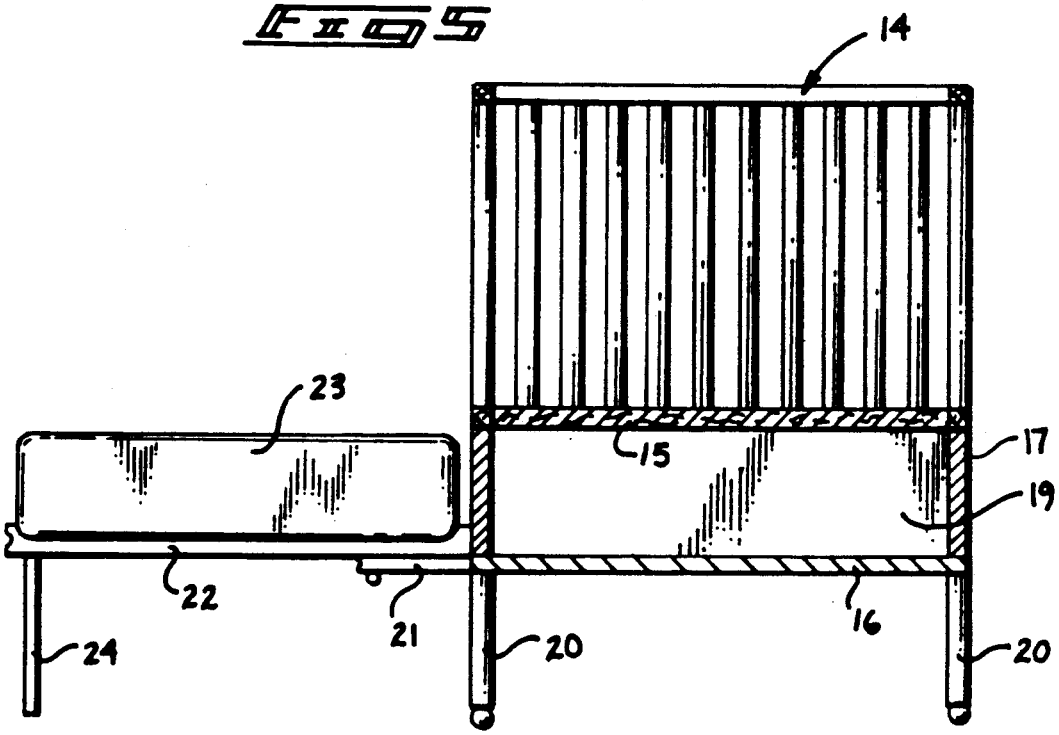
FIG. 5 is an orthographic view, taken along the lines 5—5 of FIG. 4 in the direction indicated by the arrows, illustrating the mattress in an extended orientation relative to the crib structure.
Figure 6:
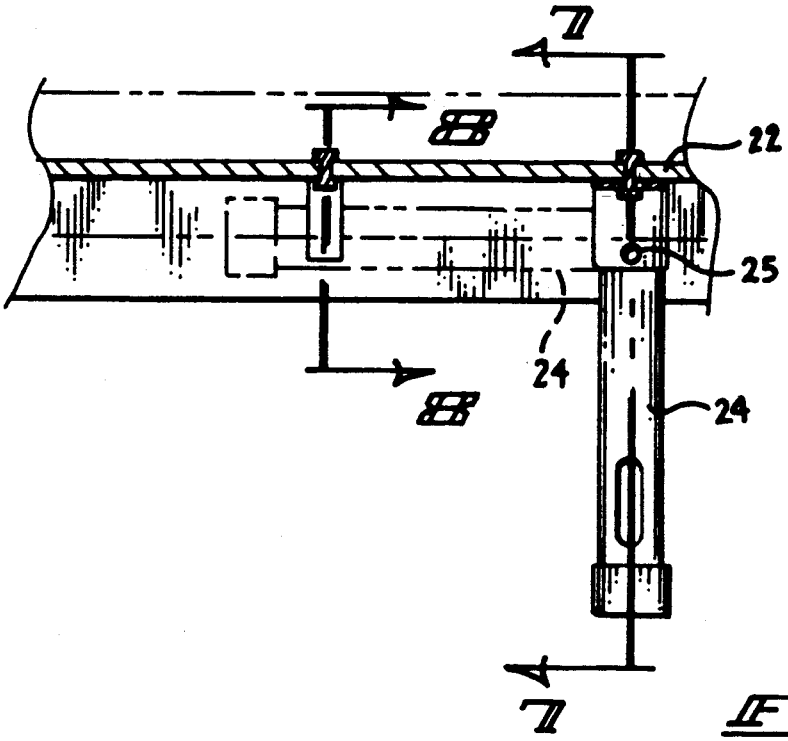
FIG. 6 is an enlarged orthographic front view of the folding leg structure in relation to the mattress support plate.
Figure 8:
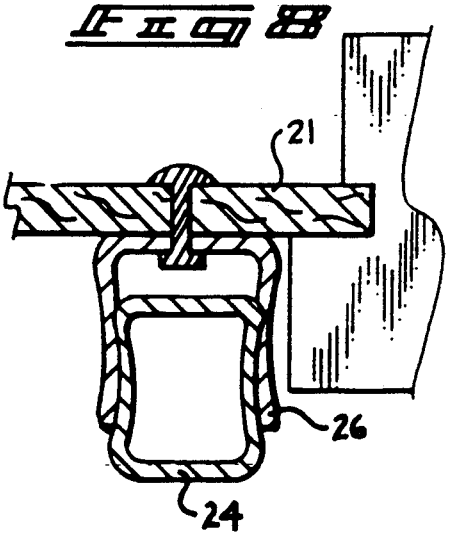
FIG. 8 is an orthographic end view of a pivotal mattress plate support leg in a folded configuration relative to the support plate.
Figure 7:
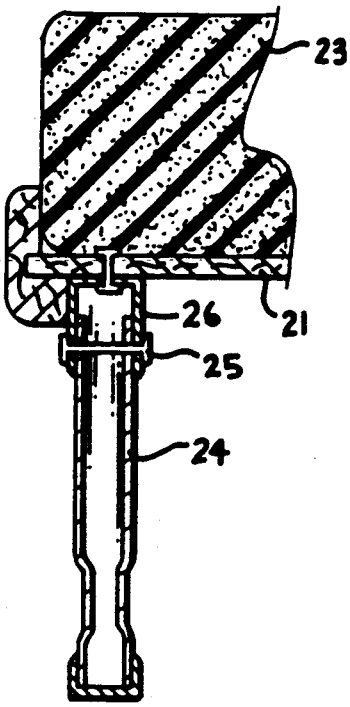
FIG. 7 is an orthographic view, taken along the lines 7—7 of FIG. 6 in the direction indicated by the arrows.

With reference now to the drawings, and in particular to FIGS. 1 to 10 thereof, a new and improved crib apparatus embodying the principles and concepts of the present invention and generally designated by the reference numerals 10 and 10*a* will be described.

More specifically, the crib apparatus 10 of the instant invention essentially comprises a crib surrounding upper wall structure defined by a rear crib wall 11 spaced from and parallel a forward crib wall 12, a headboard wall 13 spaced from and parallel a foot board wall 14. Each of the walls are defined by spaced parallel vertical bar members to provide a surrounding cage-like relationship to maintain an infant or small child therewithin, with the wall structure orthogonally mounted in a perimeter relationship relative to a top floor 15. The top floor 15 is coextensive with and spaced parallel to a bottom underlying floor 16. A "U" shaped perimeter wall 17 extends coextensively with the rear crib wall 11, the foot board wall 14, and the headboard wall 13 to define the "U" shaped perimeter wall configuration. A rectangular entrance opening 18 is positioned coextensively between the top floor 15 and the bottom floor 16 providing access to a parallelepiped mattress cavity 19. The mattress cavity 19 pivotally mounts a mattress cavity door 21 coextensively to a forward edge of the bottom floor 16 at the entrance opening 18. Upon opening of the cavity door 21, a mattress slide plate 22 is slidably mounted upon the bottom floor 16 supporting a crib mattress 23 thereon. The bottom floor 16 orthogonally mounts crib support legs 20 at each corner of the bottom floor 16, whereupon the mattress slide plate 22 includes a plurality of pivotal plate legs 24 pivotally mounted about plate leg pivot axles 25 adjacent a forward edge of the slide plate 22. Each of the plate legs 24 directs the associated leg pivot axle 25 through a "U" shaped mounting bracket 26, wherein the legs of the "U" shaped mounting bracket 26 are arranged parallel to the upper edge of the slide plate 22, whereupon complete extension of the slide plate 22 relative to the mattress cavity 19 (see FIGS. 5, 6, 7, and 8) the pivotal plate legs 24 provide support to the slide plate 22 mounting the mattress thereon.

FIGS. 9 and 10 illustrates the organization including a cabinet member 27 mounted to the slide plate 22 between the pivotal plate legs 24. The cabinet member 27 includes a forward face 28 mounting an accessory first slide drawer 29, with a second slide drawer 30 slidably mounted through the forward face 28 adjacent the first slide drawer 29. The second slide drawer 30 includes a plurality of cylindrical cavities 31 directed orthogonally through a top surface of the second slide drawer 30, with a heating plate 32 mounted and positioned at each lower end of each cylindrical cavity 31 to receive various food components for warming and heating of the food components for use by an infant. A first switch 34 electrically directs current to the heating plate 32 through an electrical transmission cable 36. A cylindrical bottle support 33 is surrounded by a bottle heating coil 33*a* coextensively about an interior surface of the cylindrical bottle support 33 for warming of an infant bottle therewithin for feeding purposes.

As to the manner of usage and operation of the instant invention, the same should be apparent from the above disclosure, to set forth an organization for care and feeding of an infant and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A crib apparatus, comprising in combination, a rear crib wall and a forward crib wall, the forward crib wall spaced from and parallel the rear crib wall coextensively therewith, and including a headboard wall spaced from and parallel a foot board wall, wherein each wall defines a continuous upper wall structure defined by spaced parallel vertical bar members, and each of said walls orthogonally mounted to a top floor, and a bottom floor coextensive with and parallel the top floor positioned below the top floor, and a "U" shaped perimeter wall extending coextensively between the top floor and bottom floor and coextensive with the respective rear crib wall, headboard wall, and foot board wall, and a parallelepiped mattress cavity defined between the top floor and bottom floor, and a rectangular entrance opening directed between the top floor and bottom floor coextensively with the forward crib wall, and a mattress cavity door hingedly mounted coextensively to a forward edge of the bottom floor, and a mattress slide plate mounted on the bottom floor arranged for reciprocation from a first position within the mattress cavity to a second position spaced exteriorly of the mattress cavity, and a mattress mounted upon the mattress slide plate, and the bottom floor defining a central opening coextensive with a top surface of the crib mattress.

2. An apparatus as set forth in claim 1 wherein the slide plate includes a slide plate forward edge, and the slide plate forward edge includes a plurality of pivotal plate legs pivotally mounted to the forward edge, wherein each of the pivotal plate legs includes a "U" shaped mounting bracket positioned adjacent the forward edge, with each "U" shaped bracket including a leg pivotal axle orthogonally oriented relative to the slide plate forward edge permitting pivotment of each plate leg from a horizontal position to a vertical position for support of the slide plate when the slide plate is spaced exteriorly from the bottom floor.

3. An apparatus as set forth in claim 2 including a cabinet member mounted to a bottom surface of the slide plate between the pivotal plate legs, with the cabinet member including a cabinet member forward face, the cabinet member forward face including an accessory first slide drawer slidably directed through the cabinet member forward face.

4. An apparatus as set forth in claim 3 including an accessory second slide drawer, the accessory second slide drawer including a plurality of cylindrical cavities directed through a top surface of the accessory second slide drawer, and each cylindrical cavity including a heating plate mounted at a lower terminal end of each cylindrical cavity, and first switch means for effecting selective heating of each heating plate.

5. An apparatus as set forth in claim 4 including a cylindrical bottle support orthogonally directed through the cabinet member forward face, with the cylindrical bottle support including heating means coextensively mounted within the cylindrical bottle support for heating of a nursing bottle contained therewithin, and a second switch directed through the cabinet member forward face for selective heating within the cylindrical bottle support.

* * * * *